United States Patent [19]

Barnes et al.

[11] Patent Number: 4,549,656

[45] Date of Patent: Oct. 29, 1985

[54] PACKAGE DEVICE AND METHOD OF MANUFACTURING

[76] Inventors: Joey L. Barnes, 167 D Quincy Ct., Bloomingdale, Ill. 60108; James K. Barnes, 143 Spring, Glen Ellyn, Ill. 60137

[21] Appl. No.: 521,621

[22] Filed: Aug. 9, 1983

[51] Int. Cl.[4] ..... B65D 83/00

[52] U.S. Cl. ..... 206/589; 206/5.1; 206/443; 206/524; 206/593; 220/21

[58] Field of Search ..... 206/589, 5.1, 486, 488, 206/489, 443, 490, 523, 524, 592–594; 220/20, 21; 217/25.5, 18

[56] References Cited

U.S. PATENT DOCUMENTS

| | | | |
|---|---|---|---|
| 1,665,214 | 4/1928 | McGraw | 206/315.1 |
| 2,012,535 | 8/1935 | Herrold | 206/539 |
| 2,534,815 | 12/1950 | Fields | 206/539 |
| 2,889,974 | 6/1959 | Sauvago | 206/3 |
| 3,338,390 | 8/1967 | Gordon | 206/306 |
| 3,446,342 | 5/1969 | Michel | 206/459 |
| 3,817,372 | 6/1974 | Smith | 206/539 |
| 3,918,920 | 11/1975 | Barber | 206/306 |

FOREIGN PATENT DOCUMENTS

| | | | |
|---|---|---|---|
| 882475 | 3/1943 | France | 206/443 |

*Primary Examiner*—William T. Dixson, Jr.
*Assistant Examiner*—Brenda J. Ehrhardt
*Attorney, Agent, or Firm*—Conlon & Kerstein

[57] ABSTRACT

A light weight, shipping package for small glass vials and the like and providing an expanded polystyrene package having a plurality of chambers aligned opposite one another and including thin outer walls formed by first producing the package as a large billet and thereafter simultaneously cutting the billet into individual packages and thus achieving an objective of having a thin wall package without the attendant high production costs normally encountered in thin wall package construction.

13 Claims, 6 Drawing Figures

PACKAGE DEVICE AND METHOD OF MANUFACTURING

BACKGROUND OF THE INVENTION (1) Field of the Invention

This disclosure pertains to packaging devices and in particular devices used for shipping small vials such as contact lens jars. The package disclosed herein is manufactured of expanded polystyrene as part of a large billet and then is cut from the billet to give the package a thin wall construction and is easily shipped by first class mail at a reduced cost which would be prohibited if manufactured as an individual unit.

(2) Description of the Prior Art

Prior art shipping containers used to transport small vials generally have provided an outer, chip board box or containers into which a thin vacuum formed plastic nesting devices are located. The small vials are then placed into the nesting device one at a time, a cover is placed on the box and the box is then enclosed in a shipping envelope and a shipping label is attached. Later a customer is invoiced for the amount. Problems have been encountered in this type of package because the vacuum formed plastic insert which holds the vials in position can be easily cracked when crushed by other packages during transit if the chip board box is not of a heavy construction. Once this crushing occurs the cracking generally migrates through the package and loosens all the vials contained therein. When the vials are loose, the shock absorbing features are greatly diminished and the vials are prone to damage and loss.

Because the outer, chip board box inherently provides much weight for shock and damage protection, the postage for mailing is high. A significant weight reduction has been achieved by the present invention which places the lighter weight package disclosed herein in a light sleeve, to be mailed at a lower rate than packages provided by prior art.

Other problems attendant with the prior art relate to the billing techniques generally used in the industry which have resulted in the products being shipped and later invoiced resulting in a yet additional postage to the shipper. By utilizing the packaging shown in this disclosure, after the packaging is initially made up the invoice can be easily slipped into the outer sleeve without dismantling the package and encountering the risk of misplacing or mixing up orders. Finally shrink wrap covering is attached to the completed assembly to maintain the invoice in place in order that the address of the recipient shows clearly through the window of the sleeve. Thus not only is postage saved but the shipper invoices his customer at the same time the product is shipped.

SUMMARY

This disclosure pertains to packages or shipping cartons and in particular to a shipping carton for small commodities such as glass vials used to transport contact lenses and the like. More specifically, the package provided herein has a thin wall thickness which has not heretofore been utilized in the packaging industry because packages made of expanded polystyrene having such a thin wall are prohibitively expensive to manufacture because the handling and drying times are great.

The thin wall package disclosed herein is made possible because it is initially manufactured as part of a large, egg crate type billet. The billet is manufactured with thick outer walls and thick inner, divider wall thickness. Such a thick wall product or billet is easy to manufacture by conventional methods and does not require excessive drying times for removal of moisture form the billet after it is removed from its mold. After the billet is removed and dried it is placed on a hot wire cutting device and which includes a jig to properly locate the billet. The hot wire cutters extend at right angles to each other and form rectangles of such dimensions to define the outer dimensions and wall thicknesses of the packages which are cut from the billet. The individual packages have very thin walls that cannot otherwise be economically manufactured.

It is thus an object of this disclosure to provide a new and inventive package for shipping small containers which is economically manufactured from expanded polystyrene having a wall thickness adequate to provide the necessary shock absorbing features to protect the product being shipped but also provide a light weight container which allows the shipper to save on shipping and/or mailing expenses.

Another object of this invention is to provide a thin wall shipping package having a number of tapered chambers spaced by separator walls and said chambers are aligned in pairs and each chamber has restraining ribs running the length thereof to produce a friction fit to securely hold product in place during handling and transit.

Another object of this disclosure is to provide a light weight package wherein the top margin of each side of the package includes a contoured cut out which extends beneath the top of the product contained within the chamber to allow the product to be easily grasped and removed.

Another object of this disclosure is to provide a package which maybe easily loaded with product for shipment and also provides a sleeve which slips over the assembled package and product loosely enough for an invoice to be placed under the sleeve and accompany the product during shipment after the package and sleeve are encapsulated in a shrink wrap plastic film.

Yet another object of this disclosure is to provide a thin wall, shock absorbing package suitable for mailing at a lower postage rate due to its light weight which is manufactured from a large, molded billet having an egg shape appearance and providing the plurality of individual molded packages which can be cut therefrom with desirable thin walls.

Another object of this disclosure is to provide a thin wall package manufactured from a process using expanded polystyrene which is formed into a large billet and then cut into individual packages which are extremely light weight.

Yet another object of this disclosure is to provide a method of manufacturing a light weight shipping package by molding a large billet of expanded polystyrene and cutting individual packages from the large billet with a hot wire cutting machine to thereby provide a uniform thin wall shipping package.

These and other objects of the disclosure will become apparent to those having ordinary skill in the art with reference to the following description, drawings and appended claims.

DESCRIPTION OF THE PREFERRED EMBODIMENT

Figure 3:
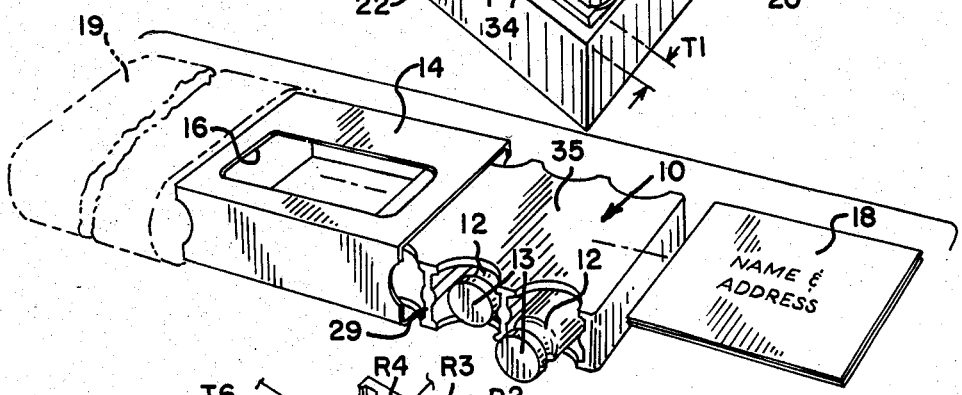
FIG. 3 is an exploded pictoral illustration showing the components generally associated with packaging and shipment of the product.

Referring now to the drawings and in particular to FIG. 3, a package designated by the numeral 10 is shown containing a number of vials 12 suitable for shipment of contact lenses and enclosed at the top by a cap 13. Package 10 or a magazine as it is oftentimes called because of the plurality of vials 12 which are contained therein, is packaged within a sleeve 14 having a window 16 adapted to display information regarding the addressee which is located on an invoice 18. The assembled unit is then enclosed in shrink wrap shown in phantom and is designated by the numeral 19. As is well known in the art, once the shrink wrap is in position it may be heated to shrink about the package to securely hold the contents therein.

Figure 1:
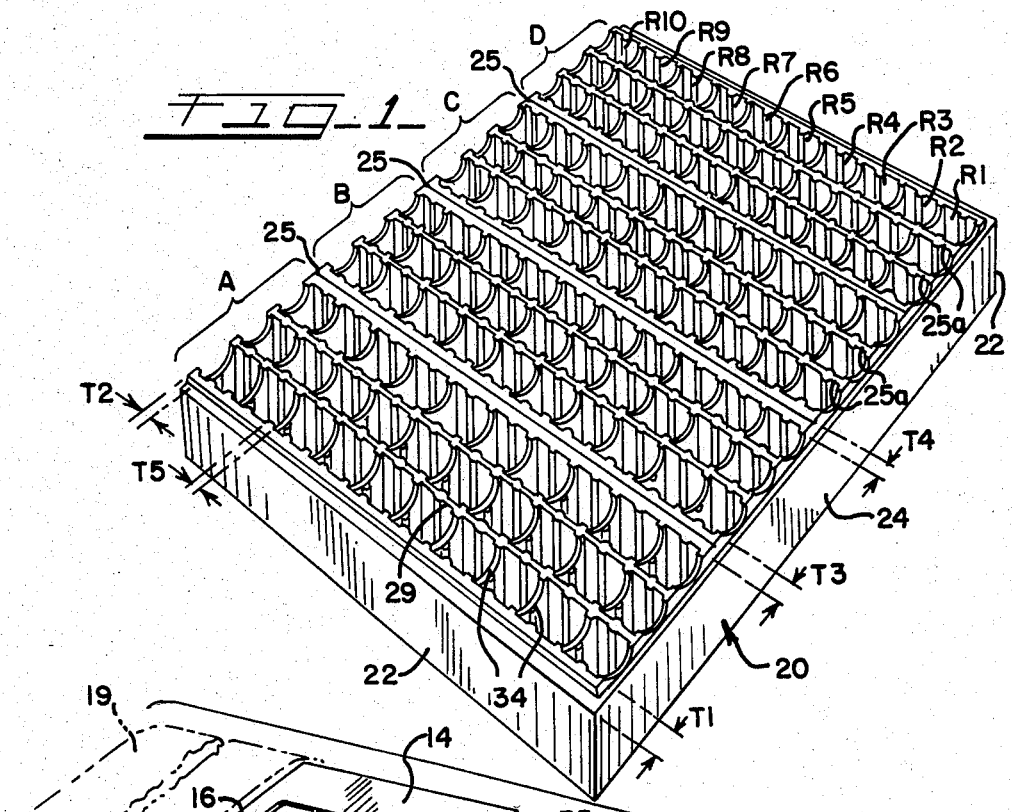
FIG. 1 is a pictoral illustration of the billet.

The package 10 is manufactured from a large billet 20 which is molded from expanded polystyrene. The billet 20 includes a number of rows of openings R1 through R10 divided into four sections which are arranged in columns designated A, B, C, and D (FIG. 1). Of course more or fewer sections and rows could be used without departing from the scope of this invention. The billet 20 includes a number of visually egg shaped openings and includes end walls 22 and sides 24. Major column dividers are designated 25 and separate the various rows into the four columns A through D mentioned above. Minor column dividers are designated 25*a*.

FIG. 1 shows that end wall 22 of billet 20 has a thickness designated T1. Side walls have a thickness designated T2. The range of thickness of the side wall and end wall (T1 and T2) is in the order of three-quarters ($\frac{3}{4}$) of an inch. The column dividers 25 have a thickness designated T3 which is approximately thirteen-sixteenths (13/16) of an inch.

Figure 2:
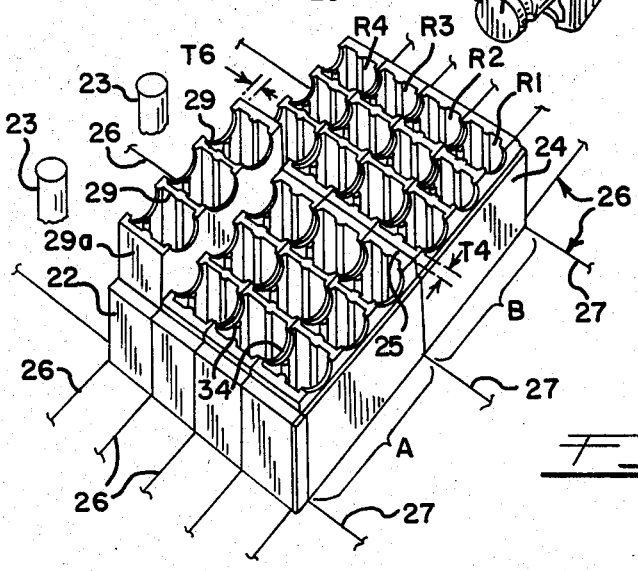
FIG. 2 is a pictoral illustration of a lower corner of the billet after cutting has occurred.
Figure 6:
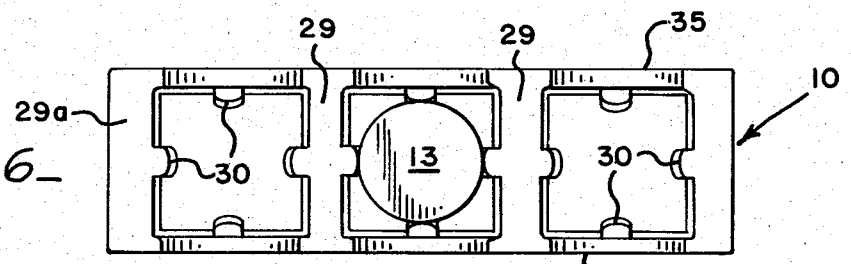
FIG. 6 is a top view of the package shown in FIG. 4.

After the billet 20 is initially molded it is removed from the mold and allowed to dry. Then it is placed in a hot wire cutting machine. The hot wire cutting machine has locating fingers 23 which are used to position the billet 20 for accurately cutting and trimming individual packages 10. The wires are shown in FIG. 2 and designated by the numeral 26 to designate these wires which cut walls 34 across columns A through D. Other wires 27 are used to cut the column dividers 25 in half. The cutting wires are one-sixteenth (1/16) of an inch thick and when heated melt an amount of material equal to their thickness. It is noticed in FIG. 2, that after the billet 20 is positioned in the cutting device the hot wires trim the thickness (T1) of the end wall 22 from approximately three-quarters ($\frac{3}{4}$) of an inch three-eights ($\frac{3}{8}$) of an inch. Also, the hot wires 26 reduce the thickness (T5) of the side walls 34 from nine-sixteenths (9/16) of an inch as shown in FIG. 1 to a thickness (T6) of one-quarter ($\frac{1}{4}$) inch as shown in FIGS. 2 and 6.

Individual packages 10 are cut from billet 20 during the hot wire cutting process. Each package 10 has six chambers 28. Internal partition walls 29 divide the chambers 28. Other separator walls 29*a* form the outside portion of the package 10 and have a thickness which is cut from nine-sixteenths (9/16) of an inch to three-eights ($\frac{3}{8}$) of and inch by the hot wire forming process. Each chamber 28 has internal restraining ribs 30 and a slightly tapered configuration to provide a friction fit tightening feature as the vials 12 are inserted therein. The ribs 30 have a bead or half moon type of contour and extend the full depth of the chamber 28. These restraining ribs are somewhat resilient and as deformed provide a gripping hold on the associated vial 12 and give the partitions 29 a corrugated contour providing strength and light weight.

Figure 4:
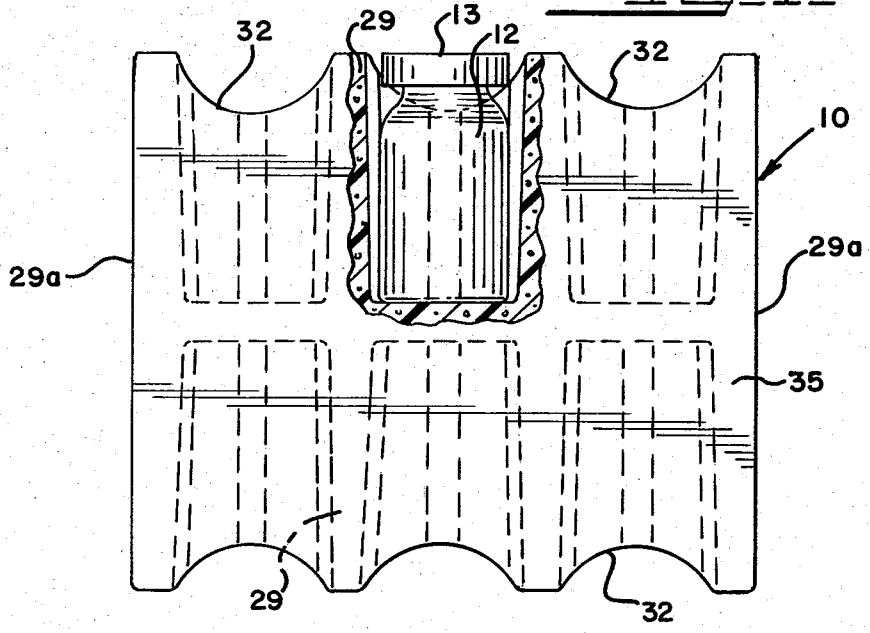
FIG. 4 is a side view, with portions removed for purposes of clarity, showing the package.
Figure 5:
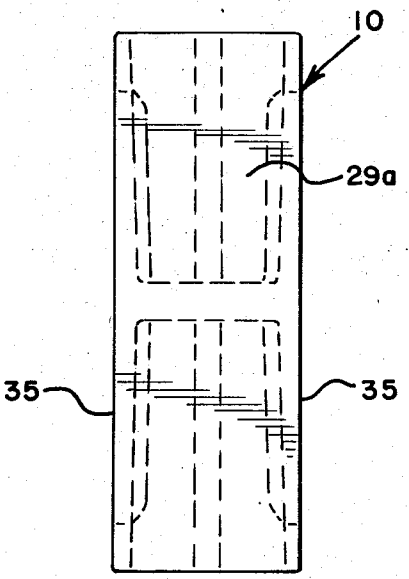
FIG. 5 is an end view of the package shown in FIG. 4.

As shown n FIG. 4, the vials 12 are completely encapsulated within the chamber 28. The package 10 extends above the top of the cap 13 to protect the vial from damage. Each chamber has a curved access cutout 32 which extends downwardly beyond the top of the vial 12 to allow the vial to be easily gripped for removal.

The billet 20 is manufactured as a single unit and because of its size has outer walls which are relatively thick and inner walls or column dividers 25 which are also relatively thick. Because of the one piece construction and the necessity of drying products molded from polystyrene, the billets can be easily removed from the mold and stacked for drying. After drying occurs the hot wire cutting takes place. The hot wire cutting cuts off the excess material from the sides 22, 24 of the billet and slices each individual package along the row dividers 34 and column dividers 25. Row dividers 34 (FIG. 2) are cut in half to produce side wall 35 having a ($\frac{1}{4}$) inch thickness. Thus the resulting package 10 has an extremely thin wall section which could not be manufactured economically by a molding process because the individual units would be too numerous to handle economically for stacking and drying. Also molding techniques would be extremely expensive to produce such a package having thin walls in the order of one-quarter ($\frac{1}{4}$) to three-eights ($\frac{3}{8}$) of an inch. The resultant product has the desirable features of a single molded package without the attendant production costs which would normally be incurred.

In use the package 10 is filled with six vials of small bottles containing contact lenses or the like. Because the bottles or vials 12 are completely enclosed there is virtually little or no damage which can occur. Because of the structural properties of expanded polystyrene, the package 10 has extreme resistance to crushing and shock forces and if one portion of the package 10 is damaged the remainder of the package will not be damaged by a migrating crack.

It is contemplated that various forms of the invention could be made. Larger or smaller billets could be produced and the invention disclosed herein is not to be limited to a billet having ten rows of three chambers manufactured in four columns on a single billet.

The package 12 disclosed herein provides a light weight shock absorbing unit for transporting small vials 12. The package also lends itself to high production schedules by utilizing a sleeve 14 which encircles the package 10 and provides absolute insurance that the vials 12 cannot be removed. The sleeve 14 has some play between it and the package 10 to allow the information regarding the addressee in the form of a paper or invoice 18 to be slipped between the sleeve 14 and the package 10. Unlike the prior art which utilizes a conventional box the package and sleeve arrangement disclosed herein need not be opened or dismantled for insertion of a shipping label or invoice. Thus the contents, once packaged, are never made accessible which could result in loss or a mix up with other products being shipped. Also, because of the light weight of this unit the assembled package is shipped at a lower mail rate producing a cost savings. Finally, the assembled package 10 sleeve 14 and shipping labels/invoice 18 is enclosed in an outer, transparent sleeve 19.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

We claim:

1. A package for shipping small commodities in a shock absorbing environment to prevent damage thereto and to facilitate handling in transit, the improvement comprising;

said package being molded of expanded polystyrene plastic;

said packages having a plurality of chambers positioned end to end and adapted to receive and restrain the commodities inserted therein;

said chambers defined by internal side walls and having a depth to thereby completely encapsulate the associated commodity to fully protect the commodity from damage while in transit and to facilitate packaging;

said chambers including ribs integral with said side walls and extending the depth of said chambers and extending into the chambers at an angle whereby the ribs converge toward one another at the bottom of the chamber to provide a wedge shaped chamber in which the resilient ribs contact the commodities to hold same in place during assembly and transit; and, said ribs being some what deformable to provide a gripping hold on an associated commodity and forming with said sidewalls a corrugated contour which provides high strength while being light weight.

2. The package of claim 1, wherein:

said ribs having a bead type contour.

3. The package of claim 2, wherein:

said side walls having contoured cutouts adjacent each chamber to allow the stored commodity to be grasped and removed.

4. The package of claim 1 and also including:

a sleeve cover which fits about the package to cover and restrain the stored commodities to prevent removal.

5. The package of claim 4 and also including:

said sleeve having an open portion to allow an identifying insert to be located between the open portion of the sleeve and the package.

6. The package of claim 5 and also including:

a plastic cover film surrounding said sleeve and package to hold each together during transit yet allow the sleeve and area behind the open portion of the sleeve to be easily viewed.

7. A package for shipping small commodities in a shock absorbing environment to prevent damage thereto and to facilitate handling in transit, the improvement comprising;

said package being molded of expanded polystyrene plastic;

said package having a plurality of chambers positioned end to end and adapted to receive and restrain the commodities inserted therein;

said chambers having a depth to thereby completely encapsulate the associated commodity to fully protect the commodity from damage while in transit and to facilitate packaging;

said chambers including ribs integral with said side walls and extending the depth of said chambers and extending into the chambers at an angle whereby the ribs converge toward one another at the bottom of the chamber to provide a wedge shaped chamber in which the resilient ribs contact the commodities to hold same in place during assembly and transit;

said ribs being somewhat deformable to provide a gripping hold on an associated commodity and forming with said sidewalls a corrugated contour which provides high strength while being light; and said container having thin side walls formed by first manufacturing the side walls with a relatively large thickness in the range of one-half ($\frac{1}{2}$) inch and then removing one-half ($\frac{1}{2}$) the wall thickness to provide a thinner wall having reduced weight while retaining the necessary strenth and shock absorbing characteristics to provide a desirable shipping container for mailing and other types of shipping.

8. The package of claim 7, wherein:

said package has side walls with contoured cutouts adjacent each chamber to allow the stored commodity to be grasped and removed.

9. The package of claim 7 and also including:

a sleeve cover which fits about the package to cover and restrain the stored commodities to prevent removal.

10. The package of claim 9, and also including:

said sleeve having an open portion to allow an identifying insert to be located between the open portion of the sleeve and the package.

11. The package of claim 10 and also including:

a plastic cover film surrounding said sleeve and package to hold each together during transit yet allow the sleeve and area behind the open portion of the sleeve to be easily viewed.

12. A billet for producing individual shipping containers, the improvement comprising:

an egg crate shaped device, manufactured of expanded polystyrene and formed by molding;

said egg shaped crate device providing a plurality of chambers in rows and divided into a plurality of columns connected by major and minor divider walls;

said billet having outer walls of four sides, each outer wall having a thickness to facilitate ease of molding;

said billet having a top half and a bottom half, each half being the same and providing aligned chambers in each half said chambers including ribs integral with said major and minor divider walls and extending the depth of said chambers and extending into the chambers at an angle whereby the ribs converge toward one another at the bottom of the chamber to provide a wedge shaped chamber in which the resilient ribs contact the commodities to hold same in place during assembly and transit; and, said ribs being somewhat deformable to provide a gripping hold on an associated commodity and forming with said major and minor divider walls which provides high strenght while being light.

13. The billet of claim 12 and further including:

internal partitions extending to connect said major and minor divider walls and having a depressed contour extending below said divider walls.

* * * * *